US008403704B2

(12) United States Patent
Marchetti et al.

(10) Patent No.: US 8,403,704 B2
(45) Date of Patent: Mar. 26, 2013

(54) ELECTRONIC CONNECTION DEVICE WITH GROUNDING FEATURE

(75) Inventors: Christophe Marchetti, Frejus (FR); Pierre Lempereur de Guerny, Tourrettes sur Loup (FR)

(73) Assignee: Schneider Electric Industries SAS, Rueil Malmaison (FR)

( * ) Notice: Subject to any disclaimer, the term of this patent is extended or adjusted under 35 U.S.C. 154(b) by 211 days.

(21) Appl. No.: 12/957,660

(22) Filed: Dec. 1, 2010

(65) Prior Publication Data

US 2011/0143592 A1 Jun. 16, 2011

(30) Foreign Application Priority Data

Dec. 10, 2009 (FR) ..... 09 58825

(51) Int. Cl.
*H01R 13/648* (2006.01)

(52) U.S. Cl. ..... 439/607.34; 439/108

(58) Field of Classification Search ..... 439/607.34, 439/607.35, 607.53, 74, 108
See application file for complete search history.

(56) References Cited

U.S. PATENT DOCUMENTS

| | | | | |
|---|---|---|---|---|
| 3,237,146 | A | 2/1966 | Barker | |
| 4,453,798 | A | 6/1984 | Asick et al. | |
| 4,655,518 | A * | 4/1987 | Johnson et al. | 439/62 |
| 5,066,236 | A * | 11/1991 | Broeksteeg | 439/79 |
| 5,104,341 | A * | 4/1992 | Gilissen et al. | 439/607.4 |
| 6,116,926 | A * | 9/2000 | Ortega et al. | 439/108 |
| 6,394,842 | B1 | 5/2002 | Sakurai et al. | |
| 6,776,629 | B2 * | 8/2004 | Shuey | 439/108 |
| 7,445,471 | B1 * | 11/2008 | Scherer et al. | 439/108 |
| 7,744,385 | B2 * | 6/2010 | Scherer | 439/101 |
| 2006/0025016 | A1 | 2/2006 | Rubenstein et al. | |
| 2007/0141871 | A1 * | 6/2007 | Scherer et al. | 439/108 |

OTHER PUBLICATIONS

French Preliminary Search Report issued Jul. 28, 2010, in French 0958825, filed Dec. 10, 2009 (with English Translation of Categories of Cited Documents).

* cited by examiner

*Primary Examiner* — Hae Moon Hyeon
(74) *Attorney, Agent, or Firm* — Oblon, Spivak, McClelland, Maier & Neustadt, L.L.P.

(57) ABSTRACT

A connection device includes a male connector furnished with several identical male contact pins and a female connector comprising a body in which reception sockets are formed designed to receive male contact pins. The body of the female connector is cased in an outer shielding element, and at least one of the identical male contact pins, called the ground pin, is arranged so as to be in contact with at least one flexible strip of the shielding element.

6 Claims, 2 Drawing Sheets

ELECTRONIC CONNECTION DEVICE WITH GROUNDING FEATURE

CROSS-REFERENCE TO RELATED APPLICATIONS

This application is based upon and claims priority under 35 U.S.C. §119 from French Patent Application No. 09 58825, filed Dec. 10, 2009.

BACKGROUND OF THE INVENTION

Field of the Invention

The present invention relates to a connection device.

A connection device typically comprises a male connector and a female connector. The male connector comprises male pins designed to be inserted into reception sockets of the female connector.

Such a connection device is known from document U.S. Pat. No. 6,394,842. This device comprises a male connector furnished with earth pins and a female connector comprising a shielded outer body furnished with flexible strips oriented inward and designed to come into contact with the earth pins of the male connector when the male connector is inserted into the female connector. This solution makes it possible to achieve the connection of the earth between the male connector and the female connector without using a specific part, but it does not make it possible to avoid the problems of crosstalk between the earth conductors and the other conductors. It is actually known that it is necessary to preserve the integrity of the signals transmitted in communication systems. To keep the integrity of the signals at a certain level, it is necessary to take account of crosstalk causing a capacitive and inductive coupling between the signals transmitted on various conductors. A signal transmitted on one conductor is therefore capable of interfering with and disrupting a signal transmitted on a conductor nearby. This phenomenon is all the more accentuated if the conductors are close.

SUMMARY OF THE INVENTION

The object of the invention is to propose a connection device that is protected against the electromagnetic radiation coming from the outside and that makes it possible to limit the emission of such radiation to the outside. Moreover, the object of the invention is also to propose a specific architecture making it possible to produce an earth connection between the male connector and the female connector without using a specific part and while preventing the phenomena of crosstalk between the earth conductors and the other conductors.

This object is achieved by a connection device comprising a male connector furnished with several identical male contact pins and a female connector comprising a body in which reception sockets are formed designed to receive male contact pins, characterized in that:

- the body of the female connector is cased in an outer shielding element,
- at least one of the identical male contact pins, called the earth pin, is arranged so as to come into contact with the outside of the shielding element.

When the male connector is connected to the female connector, as its earth pins come into contact with the outside of the shielding element, the shielding element is situated between the earth pins and the other pins and is used to form a screen. The signals carried between the two connectors are therefore not disrupted by the disruptive signals carried by the earth pins.

According to another particular feature, the number of contact pins of the male connector is different from the number of reception sockets of the female connector.

According to another particular feature, the number of contact pins of the male connector is greater than the number of reception sockets of the female connector.

According to another particular feature, the shielding element comprises a contact strip to which the earth pin is connected.

According to another particular feature, the shielding element comprises at least one member soldered to the earth of a printed circuit.

The invention also relates to a man-machine dialogue system comprising a first module furnished with man-machine dialogue means and a second module furnished with processing means, the first module being connected to the second module via a connection device as defined above.

BRIEF DESCRIPTION OF THE DRAWINGS

Other features and advantages will appear in the following detailed description with reference to an embodiment given as an example and represented by the appended drawings in which.

DETAILED DESCRIPTION OF THE INVENTION

The invention relates to a connection device comprising a male connector 1 and a female connector 2.

Figure 1:
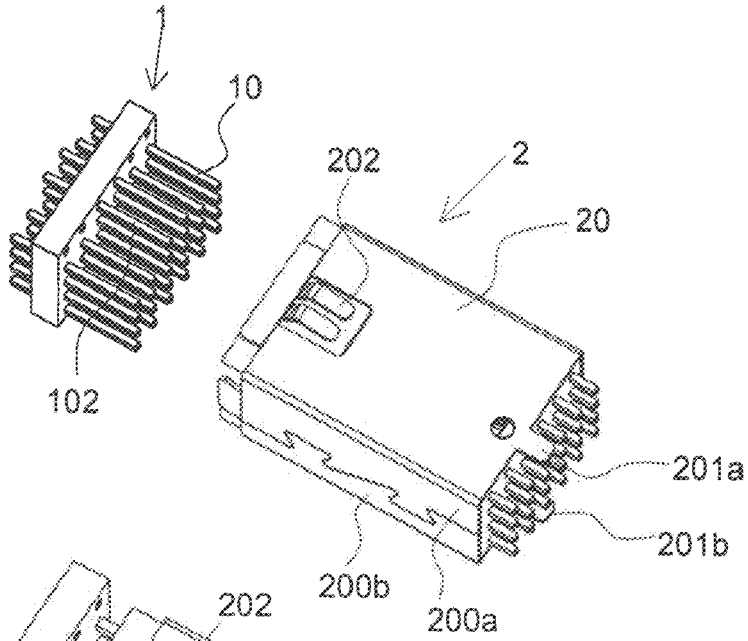
FIG. 1 represents the connection device of the invention in which the male connector is disconnected from the female connector.
Figure 2:
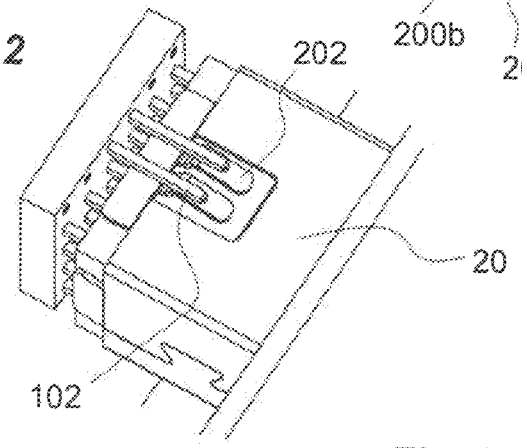
FIG. 2 represents in detail and partially the male connector connected to the female connector.

With reference to FIG. 1, the male connector 1 comprises several male contact pins 10 that are all identical and organized in rows and the female connector 2 comprises a body furnished with several reception sockets (not visible) each designed to receive a male contact pin 10 of the male connector 1.

Figure 3:
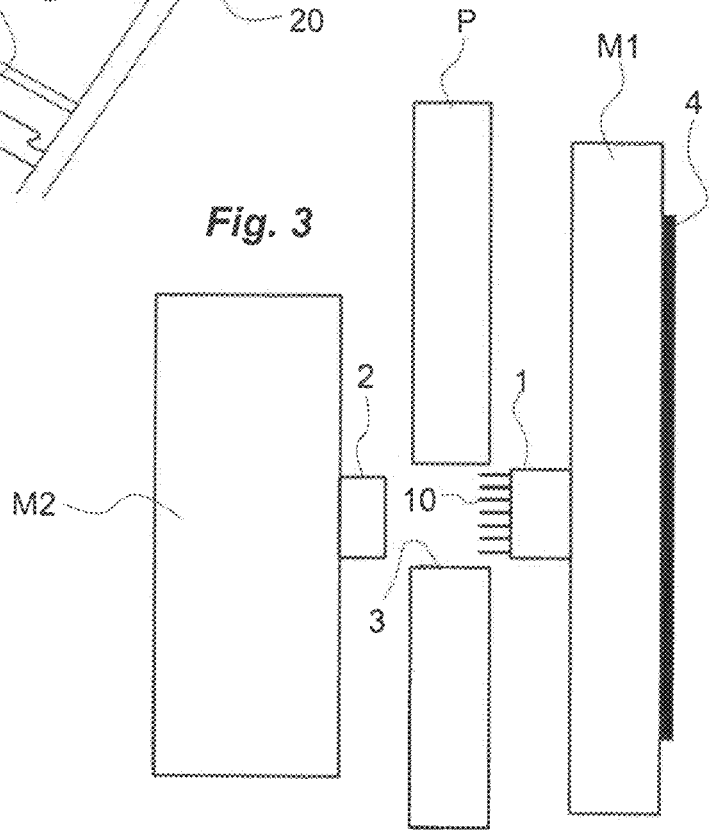
FIG. 3 represents schematically two modules using the connection device of the invention.
Figure 4:
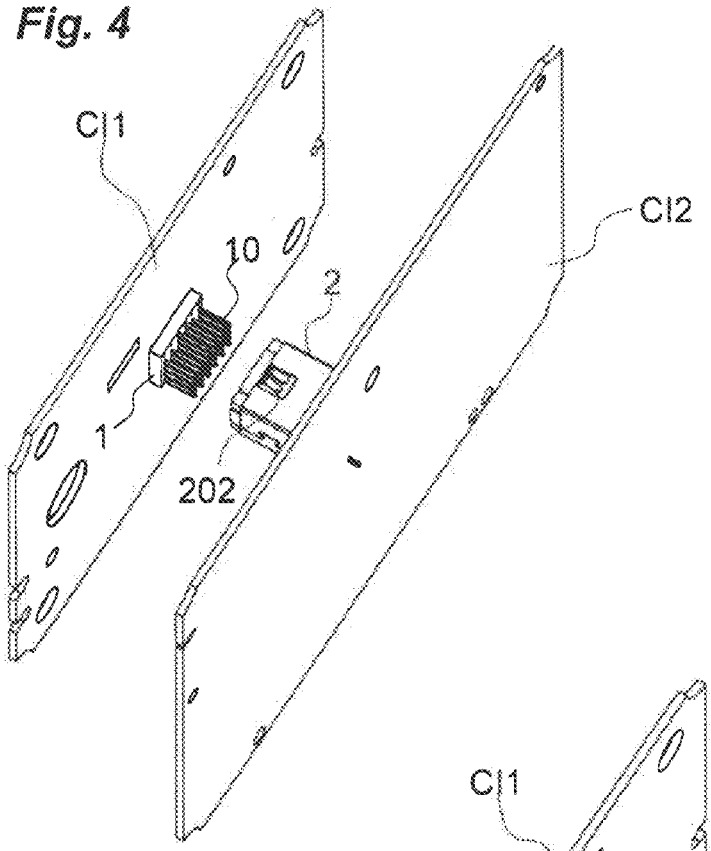
FIGS. 4 and 5 represent two printed circuits designed to be housed in the modules represented in FIG. 3 and respectively disconnected and connected with the aid of the connection device of the invention.
Figure 5:
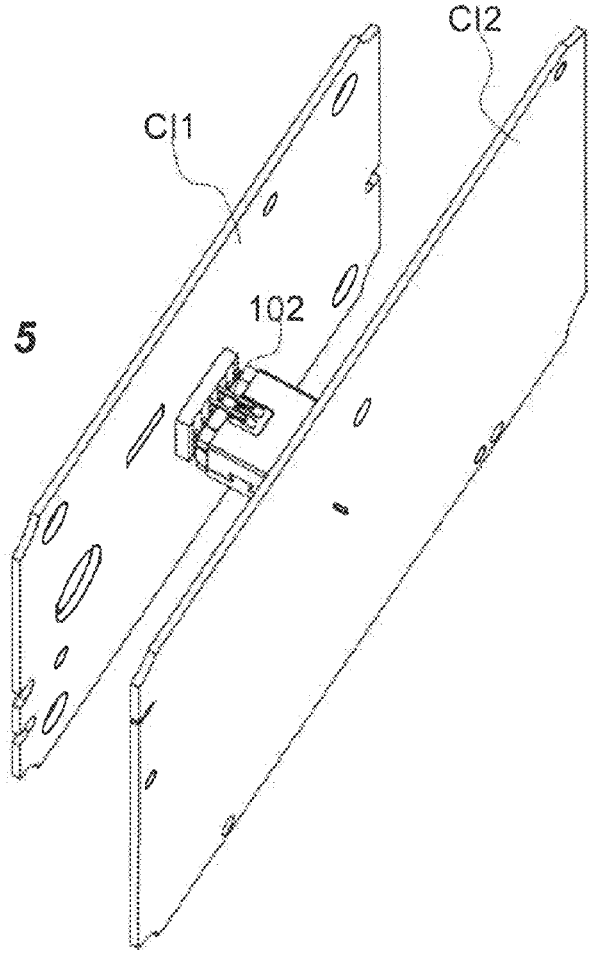

With reference to FIG. 3, the connection device of the invention is for example designed to be used in a man-machine dialogue system. This type of system comprises, for example, a first module M1 furnished with man-machine dialogue means such as for example a touch-sensitive screen 4 and/or buttons and a second module M2 comprising notably processing means. The first module M1 and the second module M2 are for example assembled together on either side of a wall P such as for example a cupboard door, through an opening 3. With reference to FIGS. 3 and 4, the electric connection between the first module M1 and the second module M2 is therefore achieved via the connection device of the invention passing through the opening 3 made in the wall P. Mechanical attachment means not shown can also be provided for assembling the first module M1 to the second module M2. The first module M1 therefore supports the male or female connector of the device and the second module M2 supports the complementary connector, respectively female or male. With reference to FIGS. 4 and 5, on the male connector 1, each contact pin 10 is soldered to a printed circuit Cl1 designed to be housed in the first module M1. On the female connector 2, each reception socket is soldered to a printed circuit Cl2 designed to be housed in the second module M2.

According to the invention, the body of the female connector 2 is cased in an outer shielding element 20 made of metal. This shielding element 20 makes it possible to protect the connection device against the electromagnetic radiation originating from the outside and to limit the emission, by the pins 10 and the sockets, of electromagnetic radiation to the outside of the device. This shielding element 20 consists, for example, of two half-shells 200*a*, 200*b* assembled around the body of the female connector 2. Each half-shell 200*a*, 200*b* comprises a lug 201*a*, 201*b* designed to be soldered to the earth of the printed circuit Cl2. Moreover, the shielding element 20 is furnished with at least one flexible strip 202 (two flexible strips in the appended figures).

The invention has the particular feature of using one of the pins 10 of the male connector to make the earth connection between the printed circuit Cl1 of the first module and the printed circuit Cl2 of the second module. Specifically, amongst the identical male contact pins 10 of the male connector 1, at least one (two pins in the appended figures), called the earth pin 102, is used to connect the printed circuit Cl1 to earth via the shielding element 20. For this, the earth pin 102 is designed to come into contact with the flexible strip 202 of the shielding element 20 when the male connector 1 is connected to the female connector 2. The earth pin 102 is therefore not inserted into a socket of the female connector 2 but rests on the flexible strip 202 situated on the outside of the body of the female connector 2 when the male connector 1 is connected to the female connector 2. The male contact pins 10 are thus arranged on the male connector 1 in order to allow one of its pins 10, that is to say the earth pin 102, to rub against the outside of the shielding element 20 and thus come into contact with the flexible strip 202 of this shielding element 20.

In order to allow the connection between the earth pin 102 and the flexible strip 202 of the shielding element, the invention therefore consists in producing on the male connector a particular arrangement of the contact pins 10 so as to leave at least one of the pins 10 on its own in a row, that is to say the earth pin 102. This pin is then positioned on the male connector so as not to interact with a reception socket of the female connector. This arrangement can be achieved for example by proposing a male connector having a number of pins 10 that is different from the number of complementary reception sockets of the female connector 2. For example, the number of pins 10 of the male connector 1 can be greater than the number of reception sockets of the female connector, thus leaving at least one pin 10 free, that is to say the earth pin 102. In another variant, the number of pins 10 of the male connector may be fewer than the number of reception sockets of the female connector 2. In this case, certain pins 10 of the male connector are removed to leave at least one contact pin 10 on its own in a row (see FIG. 1). Other configurations and solutions can of course be envisaged.

The solution of the invention therefore makes it possible to achieve an earth connection without using a specific part, merely by adapting the arrangement of the pins 10 of the male connector 1.

The invention claimed is:

1. A connection device comprising:

a male connector furnished with several identical male contact pins; and a female connector comprising a body in which reception sockets are formed designed to receive male contact pins, the body of the female connector cased in an outer shielding element, and at least one of the identical male contact pins, called a ground pin, is arranged so as to come into contact with the outside of the shielding element, the outer shielding element continuously extending around lateral sides of the body and encasing all of the reception sockets.

2. The connection device according to claim 1, wherein the number of contact pins of the male connector is different from the number of reception sockets of the female connector.

3. The connection device according to claim 1 or 2, wherein the number of contact pins of the male connector is greater than the number of reception sockets of the female connector.

4. The connection device according to claim 1, wherein the shielding element comprises a contact strip to which the ground pin is connected.

5. The connection device according to claim 1, wherein the shielding element comprises at least one member soldered to a ground of a printed circuit.

6. A man-machine dialogue system comprising:

a first module furnished with a man-machine dialogue unit;

a second module furnished with a processor; and the connection device as defined in claim 1 connecting the first module to the second module.

* * * * *